US006532687B2

(12) United States Patent
Towns et al.

(10) Patent No.: US 6,532,687 B2
(45) Date of Patent: Mar. 18, 2003

(54) FASTENER FOR FOOTWEAR

(75) Inventors: Christopher John Towns, Taunton (GB); Paul Martin Armstrong, Somerset (GB)

(73) Assignee: C. & J. Clark International Limited, Somerset (GB)

( * ) Notice: Subject to any disclaimer, the term of this patent is extended or adjusted under 35 U.S.C. 154(b) by 0 days.

(21) Appl. No.: 09/792,822

(22) Filed: Feb. 23, 2001

(65) Prior Publication Data

US 2002/0078596 A1 Jun. 27, 2002

(30) Foreign Application Priority Data

Feb. 29, 2000 (GB) ..... 0004821

(51) Int. Cl.[7] ..... A43B 3/12
(52) U.S. Cl. ..... 36/11.5; 36/50.1; 24/303
(58) Field of Search ..... 36/11.5, 50.5, 36/50.1; 24/303

(56) References Cited

U.S. PATENT DOCUMENTS

| | | | | | |
|---|---|---|---|---|---|
| 3,111,737 | A | * | 11/1963 | Heil | 24/303 |
| 4,231,137 | A | * | 11/1980 | Fujimoto | 24/303 |
| 4,249,267 | A | | 2/1981 | Voss | 2/69 |
| 4,559,678 | A | * | 12/1985 | Birkenstock | 24/302 |
| 4,646,350 | A | * | 2/1987 | Batra | 340/540 |
| 5,432,986 | A | | 7/1995 | Sexton | 24/303 |
| 6,163,938 | A | * | 12/2000 | Weber-Unger | 24/303 |
| 6,292,985 | B1 | * | 9/2001 | Grunberger | 24/303 |

FOREIGN PATENT DOCUMENTS

| | | |
|---|---|---|
| DE | 19719269 | 5/1997 |
| GB | 1125195 | 8/1968 |
| GB | 2287275 | 9/1995 |

* cited by examiner

*Primary Examiner*—Ted Kavanaugh
(74) *Attorney, Agent, or Firm*—St. Onge Steward Johnston & Reens LLC

(57) ABSTRACT

The combination of a footwear, such as a sandal and a magnetic fastener to be used to hold together a strap and other parts of the footwear. The magnetic faster includes a first body and a base support. Both have cylindrical recesses containing cylindrical magnets mounted therein. The magnets are oriented to be magnetically attractive to each other. The first body and the base support have interlocking cooperable walls to prevent shear movement of the first body and the base support relative to one another.

1 Claim, 2 Drawing Sheets

FASTENER FOR FOOTWEAR

The present invention relates to a fastener for footwear and in particular to a fastener suitable for all types and designs of footwear that employ straps for securement especially but not exclusively sandals.

Traditionally, footwear such as sandals have two or three separate straps each carrying a fastener. This enables the sandal to be securely fastened to the foot when worn but also makes the sandal easy to remove. The fastener for such sandal straps is most commonly in the form of a buckle that allows for adjustment of the length of the strap for comfort. More recently alternative fasteners such as Velcro™ have been used.

The present invention seeks to provide a new fastener for footwear that is simple and easy to operate.

The present invention provides a fastener for use on footwear comprising first and second inter-engaging devices at least one of the devices having a magnetically attractive member for holding the two devices together, the first and second inter-engaging devices further including co-operable surfaces for preventing shear movement of the devices relative to one another.

Preferably, the first device further includes handle means for enabling the device to be gripped. The first device may further include strap attachment means for securing a strap to the first device.

The second device may further include securement means for enabling securement of the second device to a surface in which the securement means may comprise a pair of flanges.

Ideally, the magnetically attractive members of the first and second devices consist of a pair of cylindrical magnets and the co-operable surfaces of the first and second devices may comprise the outer surface of a curved wall and a follower.

An embodiment of the present invention will now be described by way of example with reference to the accompanying drawings, in which.

Figure 1:
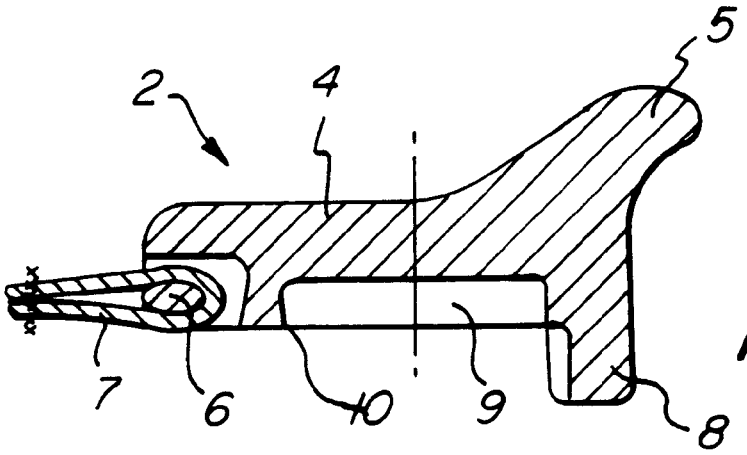
FIG. 1 is a cross-sectional view of a first part of a fastener in accordance with the present invention.

The fastener 1 consists of two inter-engaging devices: a clasp 2 and a lug member 3. In FIG. 1 the clasp 2 is shown and consists of a main body 4 with an outwardly extending grip 5, strap engaging means 6 for securing the clasp 2 to a strap 7, a downwardly depending tooth 8 and a first magnet 9. The main body 4 is preferably moulded from hard plastic such as nylon or acetal and includes a downwardly facing recess 10 in which the magnet is located. Although the strap engaging means 6 illustrated in FIG. 1 is a bar arranged to pass through a loop provided in the end of the strap 7, any suitable strap securement mechanism may be used. The magnet 9 is generally cylindrical and is located between the strap engaging means 6 and the tooth 8.

The downwardly depending tooth 8 is located at the opposite end of the main body to the strap engaging means 6 and is preferably integrally moulded with the main body 4. The tooth 8 projects beyond the exposed surface of the describes an arc that substantially corresponds to, but lies outside of, the perimeter of the first magnet 9. The tooth 8 need not comprise a single downwardly depending flange and instead may be constructed from a plurality of smaller spaced fingers. The grip 5 extends away from the tooth 8 and the main body 4 and provides a ledge that is grasped by someone wishing to release the fastener, as is described in greater detail below. The grip 5 may be made moulded with the main body 4 in a hard plastics material or may be made from a softer plastics material to improve the ease of use of the grip and enhance its tactile value. In the latter case, the grip may be moulded to the main body in a two-shot moulding process. The surface of the grip 5 may be contoured or roughened to further improve its tactile value.

Figure 2:
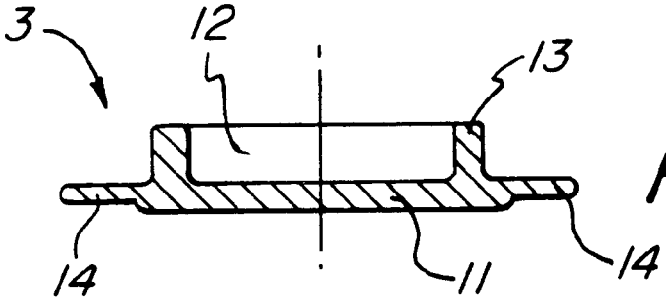
FIG. 2 is a cross-sectional view of a second part of a fastener in accordance with the present invention.

The lug 3 is illustrated in FIG. 2 and comprises a base support 11 on which is secured a second magnet 12. The second magnet 12 is also generally cylindrical and is surrounded by a perimeter wall 13 to further hold the magnet 12 in place. At opposing sides of the base support 11, flanges 14 are provided to enable the lug to be secured to a strap or upper. Whilst the base support 11 of the lug 3 is preferably moulded from hard plastics material and ideally the same material as the clasp, the flanges 14 are best moulded so as to be thinner than the rest of the fastener. This enables the flanges 14 to be stitched to a strap or upper. Alternatively, the lug may be attached to a strap or upper by means of a suitable adhesive.

The first and second magnets 9,12 are of conventional ferric material or a more specialised magnetic compound such as bonded neodemium may be used. Both are coated, for example with a plated nickel finish, to protect the magnets from corrosion. The magnets 9,12 are bonded or moulded in to the clasp 2 and lug 3 with the exposed surface of each magnet being approximately flush with the edges of the surrounding walls of either the main body 4 or the perimeter wall 13. In this way dirt can be prevented from becoming trapped in between the magnets and the mouldings in which they are mounted and can prevent dirt from partially obscuring the surface of the magnets.

Figure 4:
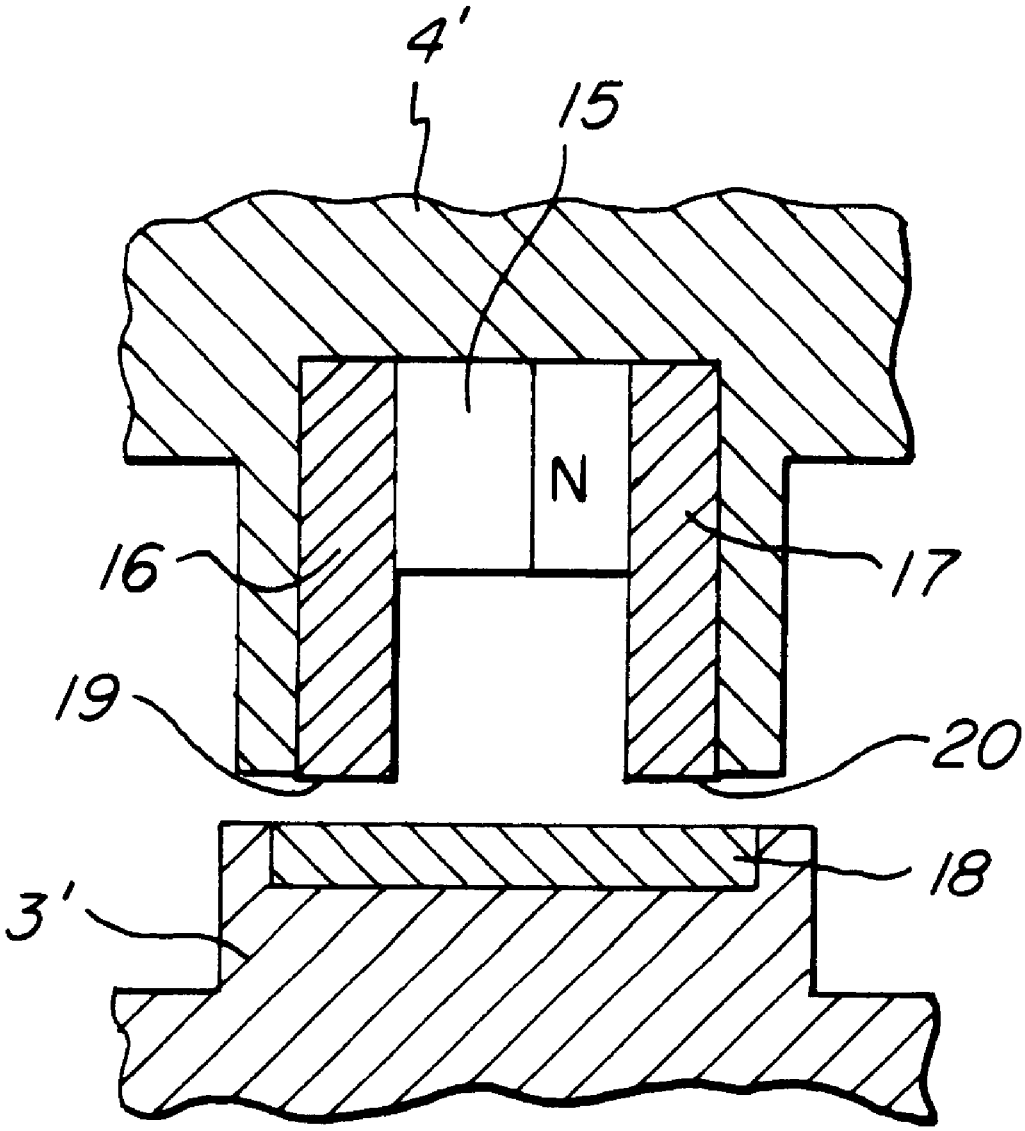
FIG. 4 illustrates an alternative fastener in accordance with the present invention.

Although the magnets 9,12 are shown to be cylindrical in the accompanying Figures, it will be appreciated that the magnets may be alternative shapes. However, it is preferred that each magnet has a large exposed face for contact with the face of the opposing magnet. Moreover, although it would be preferable for both magnetic members to be permanently magnetised, in an alternative embodiment only one of the magnetic members is permanently magnetised and the second of the magnetic members is constructed from a material that is attracted to the opposing magnetic member. In FIG. 4 an alternative fastener is shown which employs a single magnet. With this arrangement the magnet 15 is mounted in the main body 4' with opposing metal bands 16,17 either side of the magnet 15. In the lug 3' a metal plate 18 is provided that extends so as to engage with end faces 19,20 of the metal bands. In this way a flux circuit is established from the magnet 15 through,the metal bands 16,17 and the plate 18 back to the magnet 15. The metal bands 16,17 and the plate 18 may be made from steel, for example. Such an arrangement has an advantage over two magnet arrangements of lower material costs as well as concealment and protection for the magnet.

Figure 3:
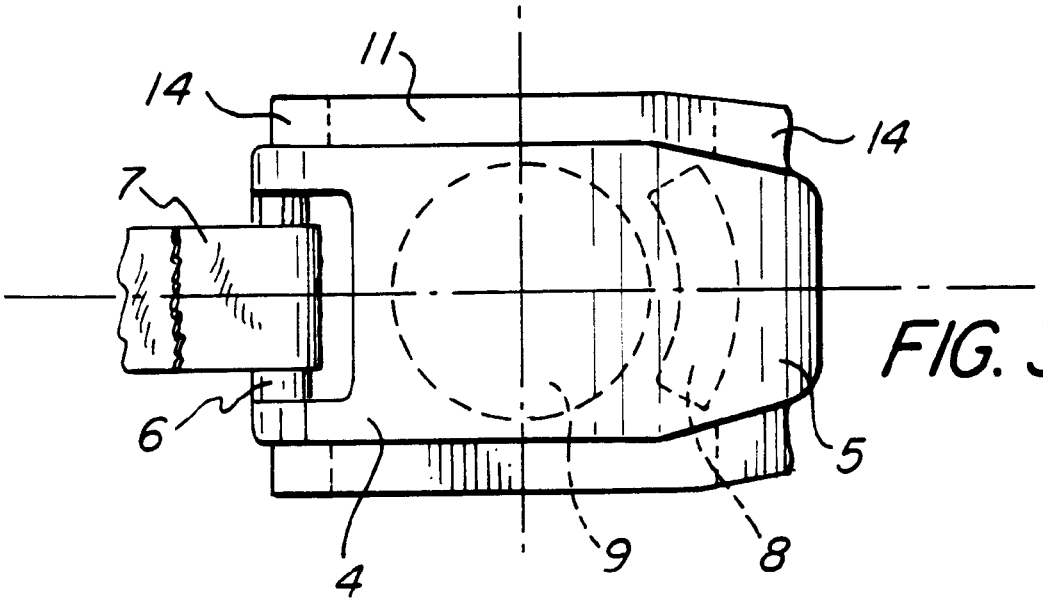
FIG. 3 is an illustration of a fastener in accordance with the present invention with the two parts engaged.

As shown in FIG. 3 when the clasp 2 and lug 3 engage one another the exposed faces of the first and second magnets 9,12 are brought into contact and are aligned. The tooth 8 engages the perimeter wall 13 of the lug 3 to prevent relative shear movement of the clasp and the lug. However, as the tooth 8 describes an arc and the perimeter wall 13 substantially matches the curvature of the tooth, pivotal relative movement of the clasp and lug is enabled. In this way the outer surface of the perimeter wall and the tooth act as co-operating cam surface and follower. The ability of the clasp and lug to pivot with respect to one another is particularly advantageous with sandal constructions.

Although the fastener may have only one lug and so be restricted in its fastening position, it possible for a plurality of lugs to be provided on a strap or the upper in a line to allow for different fastening positions. Adjustments to the structure and arrangement of the parts of the fastener are envisaged without departing from the spirit and scope of the present invention.

What is claimed is:

1. The combination of a sandal and a fastener;

said sandal having a sandal strap and an opposing sandal body;

said fastener comprising a first body and a base support, said first body having a cylindrical recess, said cylindrical recess having a first cylindrical magnet mounted therein, said sandal strap being attached to said first body; said base support forming a cylindrical tube with one closed end and one open end, said cylindrical tube containing a second cylindrical magnet, said base support having a flange extending from said closed end of said base support, said base support being secured to said sandal body by said flange;

said first and second magnets being oriented to be magnetically attractive to each other;

said first body having a laterally extending grip portion sized to provide a finger grippable ledge of a size to allow sufficient leverage to separate the first and second magnets by lifting the grip portion;

said first body having a curved, downwardly extending wall which seats against and receives a curved outer wall of said cylindrical base portion to prevent shear movement of the first body and the base support relative to one another without mechanical interengagement of said curved downwardly extending wall and said curved outer wall of said cylindrical base portion;

said first body and said base support being capable of pivoting relative movement when said first cylindrical magnet of said first body is magnetically engaged by said second cylindrical magnet of said base support.

* * * * *